US006655441B2

(12) United States Patent
Wen et al.

(10) Patent No.: US 6,655,441 B2
(45) Date of Patent: Dec. 2, 2003

(54) FRICTION TRANSMISSION MECHANISM FOR A MOTOR-DRIVEN BLIND

(75) Inventors: Yu-Che Wen, Taoyuan (TW); Song-He Lui, Kaohsiung (TW)

(73) Assignees: Industrial Technology Research Institute, Hsinchu Hsien (TW); Nien Made Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 10/143,330

(22) Filed: May 14, 2002

(65) Prior Publication Data

US 2003/0168184 A1 Sep. 11, 2003

(30) Foreign Application Priority Data

Mar. 7, 2002 (TW) ..... 91202679 U

(51) Int. Cl.[7] ..... E06B 9/26

(52) U.S. Cl. ..... 160/168.1 P; 160/170 R; 160/176.1 P; 160/DIG. 17

(58) Field of Search ..... 160/168.1 P, 170 R, 160/176.1 P, 171 R, DIG. 17, 295, 310

(56) References Cited

U.S. PATENT DOCUMENTS

| | | | | | |
|---|---|---|---|---|---|
| 2,758,644 | A | * | 8/1956 | Virlouvet | 160/170 R |
| 3,310,099 | A | * | 3/1967 | Hunter et al. | 160/171 R |
| 3,603,372 | A | * | 9/1971 | Dietzsch | 160/168.1 P |
| 3,809,143 | A | * | 5/1974 | Ipekgil | 160/168.1 P |
| 4,096,903 | A | * | 6/1978 | Ringle | 160/176.1 P |
| 5,228,491 | A | * | 7/1993 | Rude et al. | 160/171 R |

* cited by examiner

*Primary Examiner*—David Purol
(74) *Attorney, Agent, or Firm*—Browdy and Neimark PLLC

(57) ABSTRACT

A friction transmission mechanism for a motor-driven blind is constructed to include a driving unit, and at least one cord roll-up unit controlled to the driving unit to lift/lower or tilt the slats of the motor-driven Venetian blind. Each cord roll-up unit includes an amplitude modulation wheel controlled by the driving unit to lift/lower the slats and bottom rail of the Venetian blind, a frequency modulation wheel for rotation with the amplitude modulation set to tilt the slats of the Venetian blind, spring elements, which forces the frequency modulation wheel into friction-engagement with the amplitude modulation wheel, and a support supporting the amplitude modulation wheel, the support having a shoulder adapted to act with a protruding block of the frequency modulation wheel and to further limit angle of rotation of the frequency modulation wheel.

9 Claims, 7 Drawing Sheets

FRICTION TRANSMISSION MECHANISM FOR A MOTOR-DRIVEN BLIND

BACKGROUND OF THE INVENTION

1. Field of the Invention

The present invention relates to Venetian blinds and, more specifically, to a friction transmission mechanism for a motor-driven blind.

2. Description of the Related Art

A regular Venetian blind comprises headrail, a bottom rail, a plurality of slats arranged in parallel between the headrail and the bottom rail, an amplitude modulation control mechanism for controlling lifting and positioning of the bottom rail to change the extending area of the blind, a frequency modulation control mechanism for controlling the tilting angle of the slats to regulate the light. The amplitude modulation control mechanism comprises an endless lift cord suspended from the headrail at one lateral side for pulling by hand to lift/lower the bottom rail. The frequency modulation control mechanism comprises a frequency modulation member disposed at one lateral side of the blind for permitting rotation by the user to regulate the tilting angle of the slats. When adjusting the elevation of the bottom rail, the user must approach the blind and pull the lift cord by hand with much effort. Further, because the lift cord is not kept out of reach of children, children may pull the lift cord for fun. In case the lift cord is hung on a child's head, a fetal accident may occur.

U.S. Pat. No. 5,103,888 discloses a motor-driven blind, which keeps the lift cord from sight. According to this design, a motor is mounted in the headrail or bottom rail, and controlled by a remote controller to roll up or let off the lift cord. The motor is used to control lifting of the lift cord only. When adjusting the tilting angle of the slats, the user must approach the blind and touch-control a tilting control unit. This operation manner is still not convenient.

SUMMARY OF THE INVENTION

The present invention has been accomplished to provide a friction transmission mechanism for a motor-driven blind, which eliminates the aforesaid drawbacks. It is the main object of the present invention to provide a friction transmission mechanism for a motor-driven blind, which controls lifting/lowering of the slats and bottom rail of the Venetian blind as well as tilting of the slats. It is another object of the present invention to provide a friction transmission mechanism for a motor-driven blind, which is compact, and requires less installation space. It is still another object of the present invention to provide a friction transmission mechanism for motor-driven blind, which is inexpensive to manufacture. To achieve these objects of the present invention, the friction transmission mechanism is installed in a motor-driven Venetian blind and adapted to lift/lower the slats and bottom rail of the Venetian blind and to tilt the slats, comprising at least one cord roll-up unit and a driving unit adapted to drive the cord roll-up unit. The cord roll-up unit comprises: an amplitude modulation set, the amplitude modulation set comprising a support, an amplitude modulation lift cord connected to the slats and bottom rail of the Venetian blind and adapted to lift/lower the slats and bottom rail of the Venetian blind, and an amplitude modulation wheel pivoted to the support and coupled to the driving unit for free rotation relative to the support to roll up/let off the amplitude modulation lift cord upon operation of the driving unit, the support comprising a shoulder at one side thereof; a frequency modulation set, the frequency modulation set comprising a frequency modulation lift cord adapted to tilt the slats of the Venetian blind, and a frequency modulation wheel sleeved onto the amplitude modulation wheel and adapted to roll up/let off the frequency modulation lift cord, the frequency modulation wheel comprising a protruding block adapted to act against the shoulder of the support to limit rotation of the frequency modulation wheel within a predetermined angle; and a linkage, the linkage comprising spring means mounted in between the support and the frequency modulation wheel and forcing the frequency modulation wheel against the amplitude modulation wheel to produce a friction resistance that causes the frequency modulation wheel to be rotated with the amplitude modulation wheel upon rotary motion of the amplitude modulation wheel.

DETAILED DESCRIPTION OF THE PREFERRED EMBODIMENT

Figure 1:
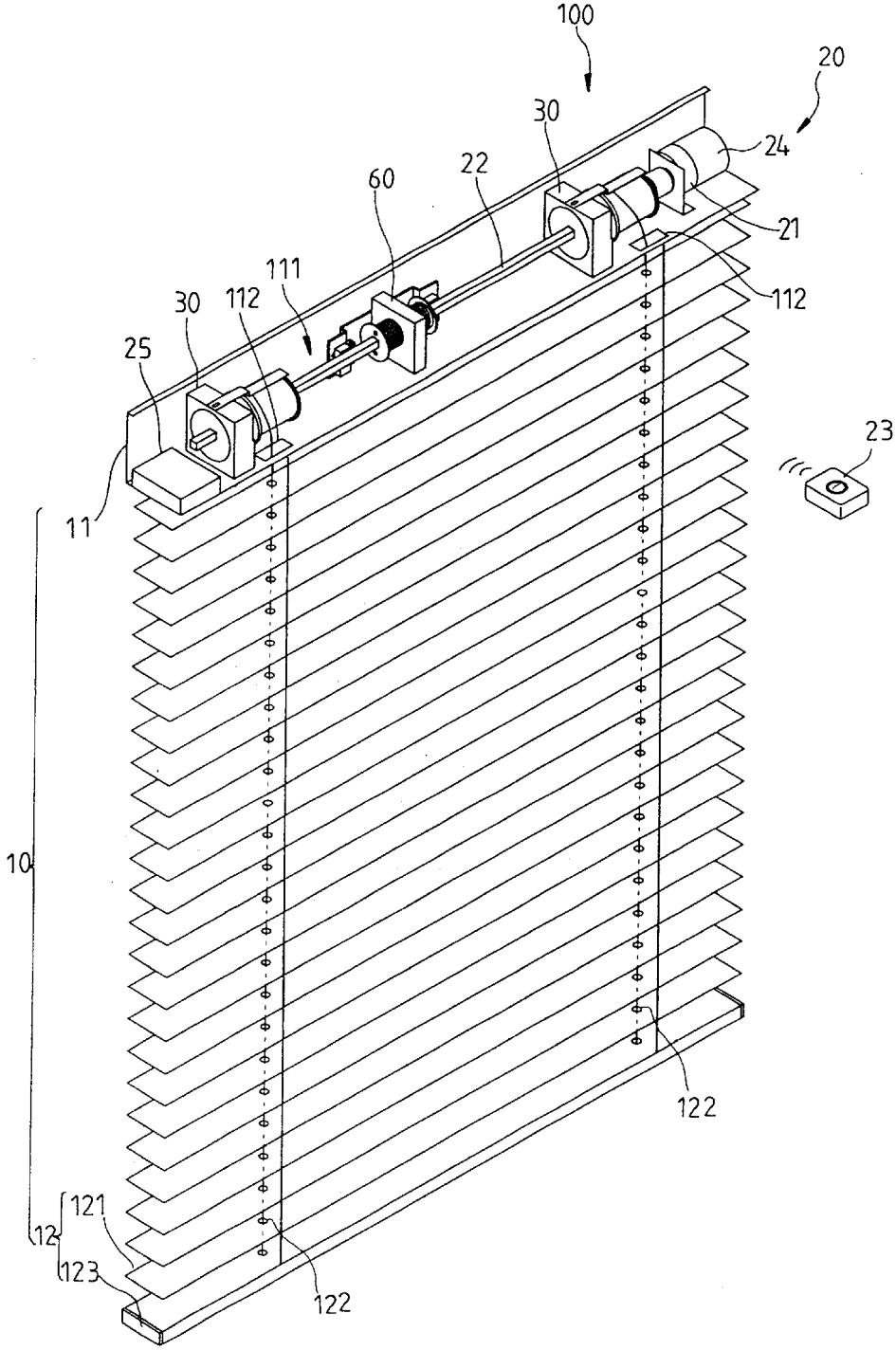
FIG. 1 is an applied view of the present invention, showing the friction transmission mechanism installed in a Venetian blind.
Figure 2:
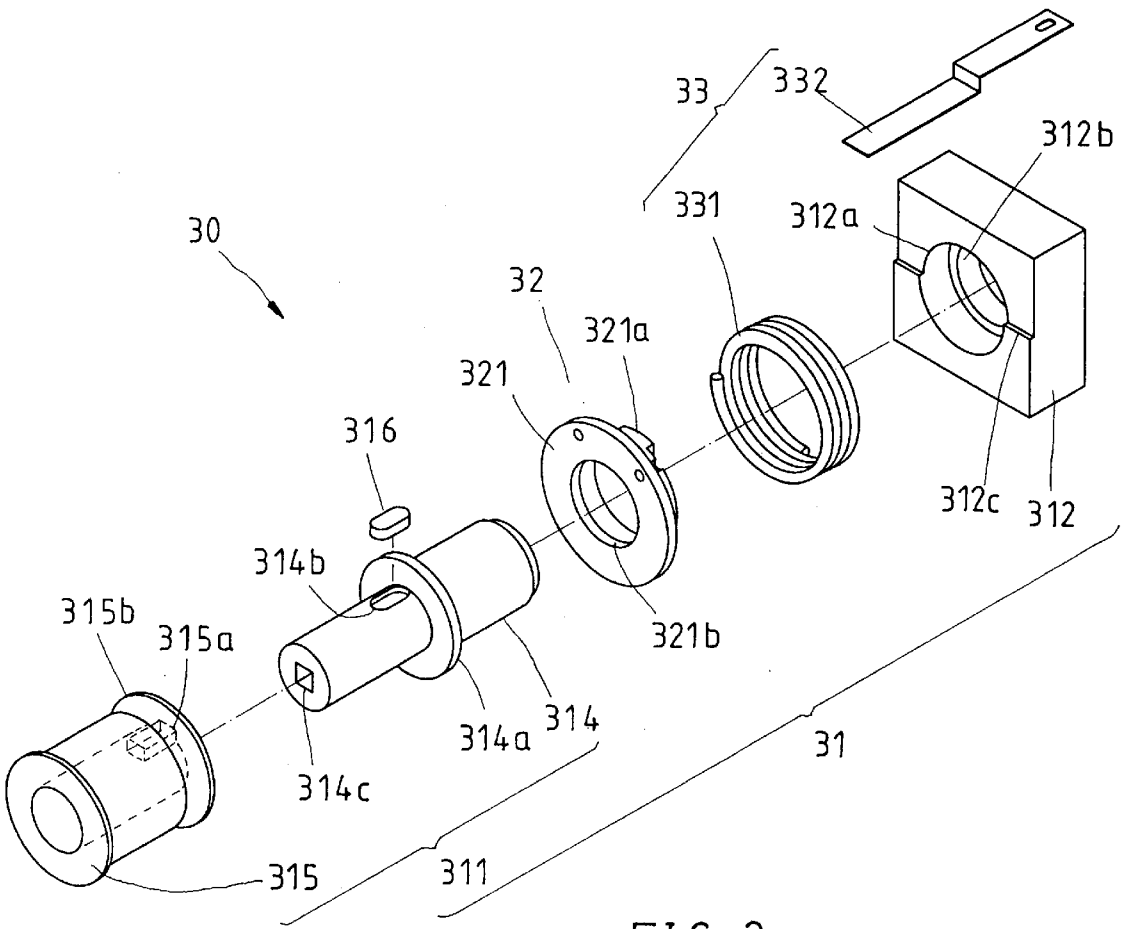
FIG. 2 is an exploded view of the cord roll-up unit for the friction transmission mechanism according to the present invention.

Referring to FIGS. From 1 through 4, the present invention provides a friction transmission mechanism 100 mountable to a Venetian blind 10. The Venetian blind 10, as shown in FIG. 1, comprises a headrail 11 and a slat set 12. The headrail 11 is mountable to the top side of the window, comprising an inside holding chamber 111, and two through holes 112 bilaterally disposed at a bottom side in communication with the holding chamber 111. The slat set 12 is comprised of a plurality of slats 121 and a bottom rail 123. Each slat 121 has two-wire holes 122 corresponding to the through holes 112 of the headrail 11. Because the Venetian blind 10 is of the known art, no further detailed structural description is necessary. The friction transmission mechanism 100 comprises a driving unit 20 and two cord roll-up units 30.

As shown in FIG. 1, the driving unit 20 comprises a reversible motor 21, a transmission shaft 22, a signal transmitter 23, a signal receiver 24, and a battery 25. The motor 21 is mounted inside the holding chamber 111 of the headrail 11. The transmission shaft 22 is a non-circular rod member, having one end coupled to the motor 21 for rotation by the motor 21. The signal transmitter 23 can be a remote controller or wired controller for providing control signal to the signal receiver 24. According to the present preferred embodiment, the signal transmitter 23 is a remote controller. The signal receiver 24 is electrically connected to the motor 21, and adapted to control the operation of the motor 21 subject to the nature of the control signal received from the signal transmitter 23. The battery 25 can be storage battery, dry battery, planar battery, cylindrical battery, or mercury battery mounted inside of the holding chamber 111 and electrically connected to the motor 21 to provide the motor 21 with the necessary working power. The cord roll-up units 30 are respectively mounted inside the holding chamber 111 of the headrail 11 corresponding to the through holes 112, each comprised of an amplitude modulation set 31, a frequency modulation set 32, and a linkage 33.

Figure 3:
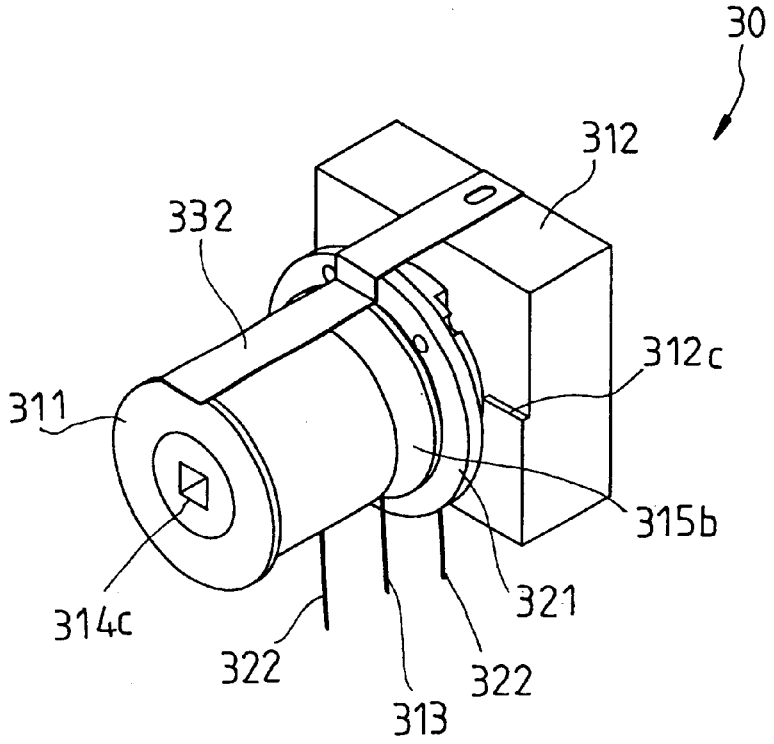
FIG. 3 is an elevational assembly view of the cord roll-up unit shown in FIG. 2.
Figure 4:
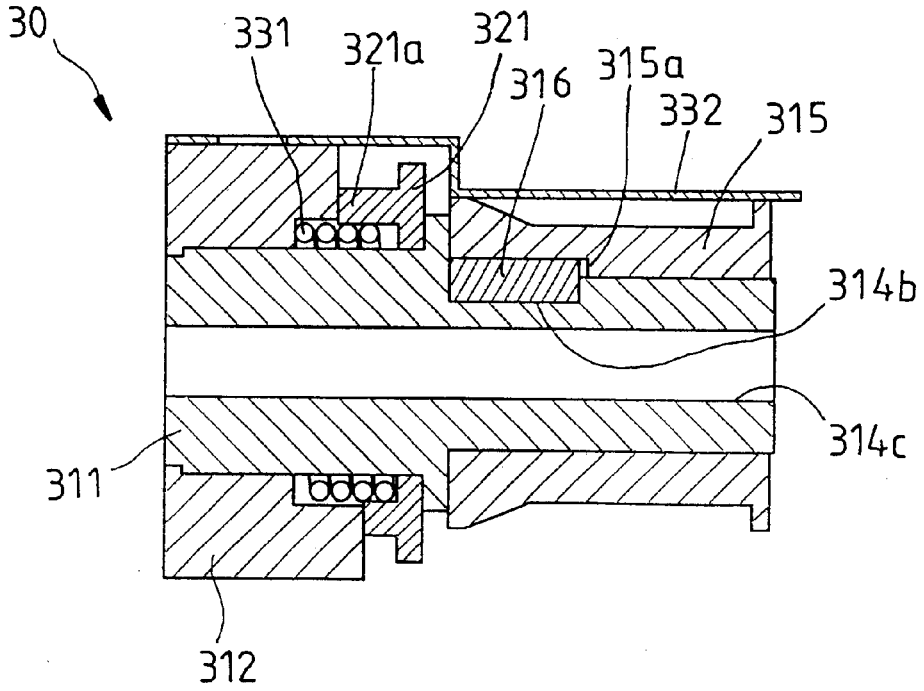
FIG. 4 is a sectional view of the cord roll-up unit shown in FIG. 3.
Figure 9:
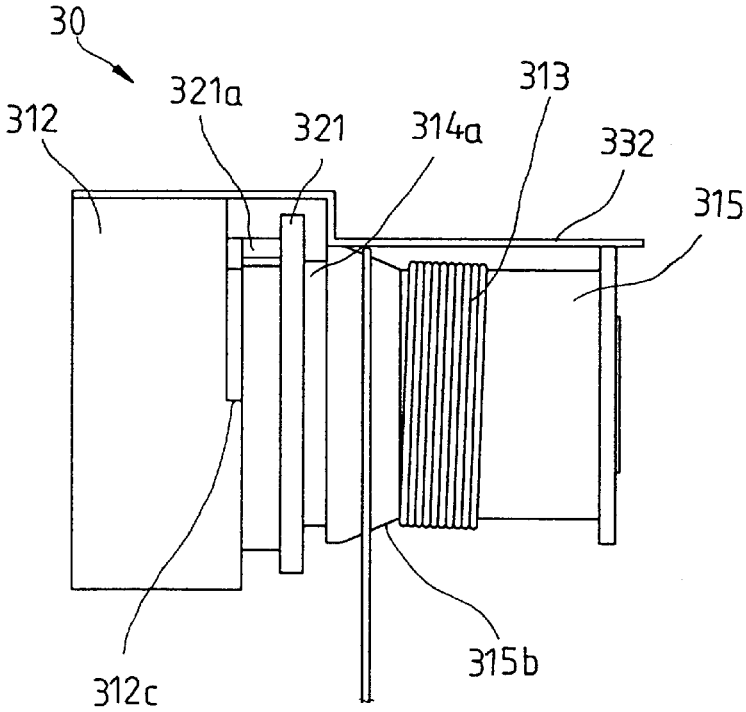
Figure 10:
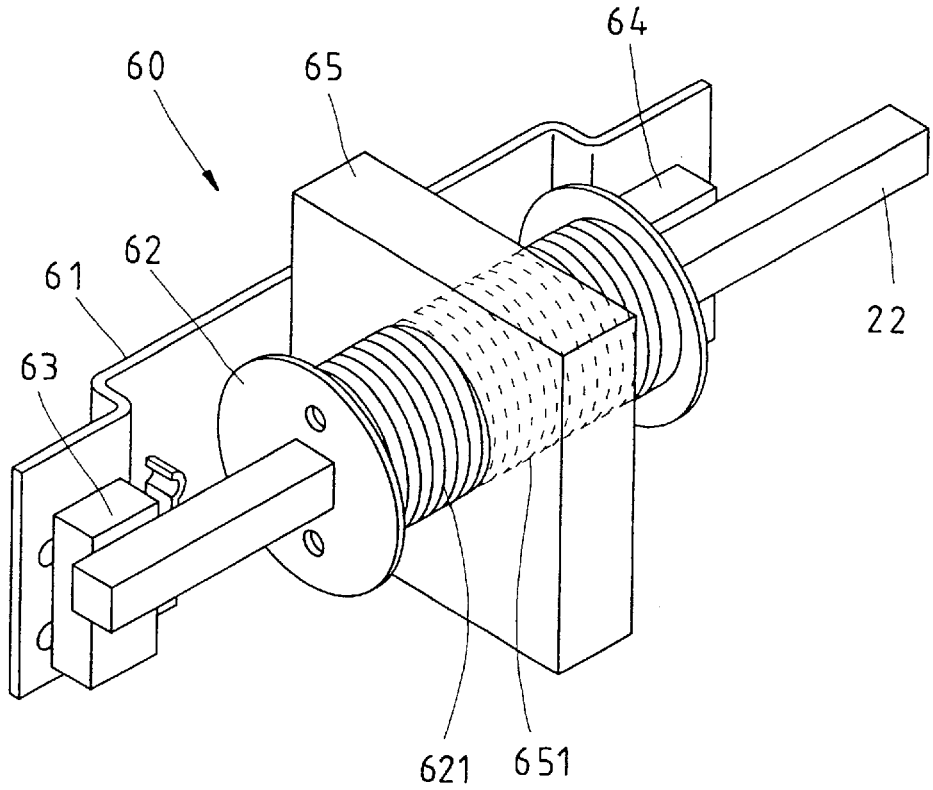
FIG. 10 is a perspective view in an enlarged scale of the detector shown in FIG. 1.
Figure 11:
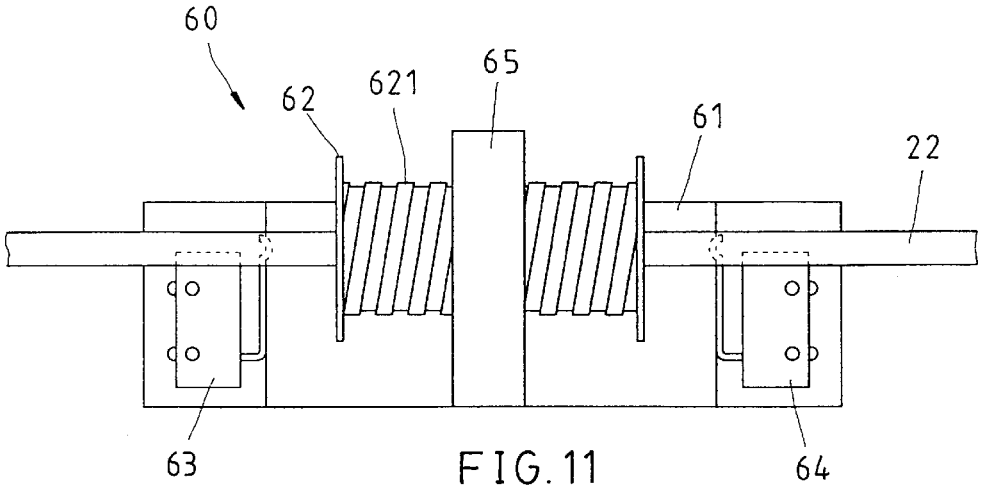
FIGS. 11~13 are schematic drawings showing the action of the detector according to the present invention.
Figure 12:
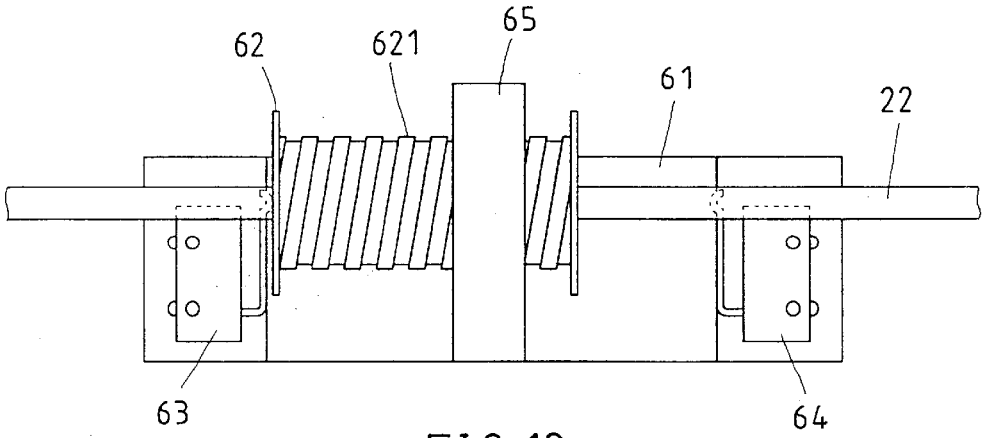
Figure 13:
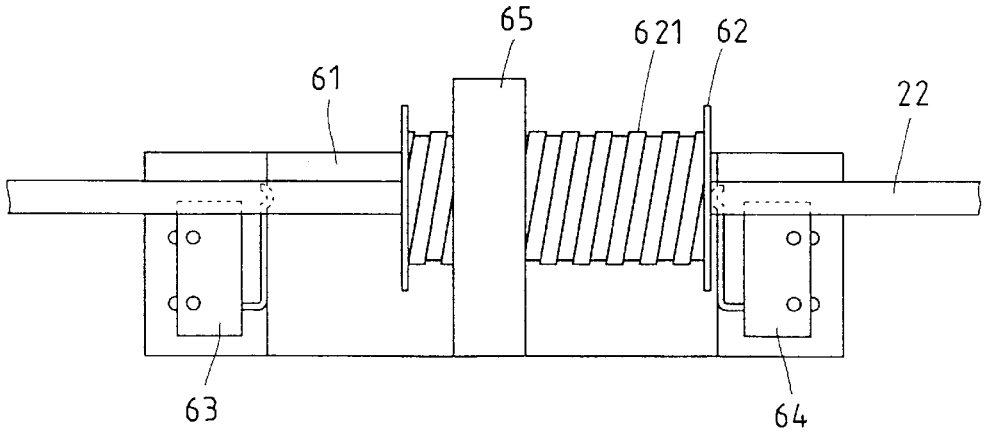

Referring to FIGS. From 2 through 4 again, the amplitude modulation set 31 comprises an amplitude modulation wheel 311, a support 312, and an amplitude modulation lift cord 313. The amplitude modulation wheel 311 is comprised of a cylindrical wheel body 314, a bobbin 315, and a coupling member 316. The cylindrical wheel body 314 comprises a stop flange 314*a* extended around the periphery on the middle, a recessed hole 314*b* disposed in the periphery adjacent the stop flange 314*a* for accommodating the coupling member 316, and an axially extended center through hole 314*c* for accommodating the transmission shaft 22 of the driving unit 20. The center through hole 314*c* has a cross section fitting the cross section of the transmission shaft 22. The bobbin 315 is sleeved onto the cylindrical wheel body 314 and stopped at one side of the stop flange 314*a*, having a keyway 315*a* in the inside wall thereof for receiving the coupling member 316 and a conical end portion 315*b* peripherally disposed at one end. The support 312 is fixedly mounted inside the holding chamber 111 of the headrail 11, having a stepped center through hole formed of a through hole 312*b* and a recessed hole 312*a*, and two shoulders 312*c* bilaterally disposed outside the recessed hole 312*a*. The inner diameter of the through hole 312*b* is smaller than the recessed hole 312*a*. The cylindrical wheel body 314 is pivoted to the recessed hole 312*a*. As illustrated in FIGS. 1, 3 and 9, the amplitude modulation lift cord 313 has one end fixedly connected to the bobbin 315 of the amplitude modulation wheel 311, and the other end wound round the bobbin 315 and then inserted through one through hole 112 of the headrail 11 and one wire hole 122 of each slat 12 and then fixedly connected to the bottom rail 123.

The frequency modulation set 32 is comprised of a frequency modulation wheel 321, and a frequency modulation lift cord 322. The frequency modulation wheel 321 comprises a protruding block 321*a* disposed at one side, and an axially extended circular hole 321*b*. By means of the circular hole 321*b*, the frequency modulation wheel 321 is coupled to the cylindrical wheel body 314 of the amplitude modulation wheel 311 and stopped at one side of the stop flange 314*a*, keeping the protruding block 321a suspended between the shoulders 312*c*. The frequency modulation lift cord 322 has one end fixedly connected to the frequency modulation wheel 321, and the other end inserted through one through hole 112 of the headrail 11 and fixedly connected to each slat 121 and the bottom rail 123.

The linkage 33 comprises a spring member 331, and a limiter 332. According to the present preferred embodiment, the spring member 331 is a coiled spring mounted in the recessed hole 312*a* of the support 312 and stopped between the frequency modulation wheel 321 and the connection area between the recessed hole 312*a* and the through hole 312*b*. The spring 331 forces the frequency modulation wheel 321 against the stop flange 314*a* of the cylindrical wheel body 314. The limiter 332 is fixedly mounted on the support 312, preventing the frequency modulation wheel 321 from falling out of the amplitude modulation wheel 311.

Figure 8:
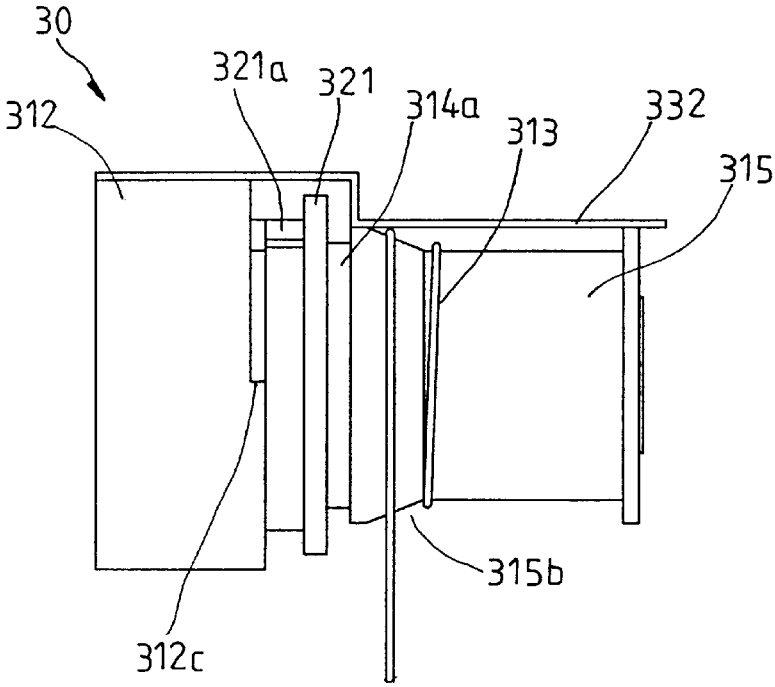
FIGS. 8 and 9 are schematic drawings showing lift cord rolling up action of the amplitude modulation set according to the present invention.

The operation of the present invention is outlined hereinafter with reference to FIGS. from 5 through 9, when the user operated the signal transmitter 23 of the driving unit 20 to transmit a control signal of lifting the Venetian blind, the signal receiver 24 immediately receives the signal. Upon receipt of the signal, the signal receiver 24 drives the motor 21 to rotate the transmission shaft 22. Because the center through hole 314*c* of the cylindrical wheel body 314 of the amplitude modulation wheel 311 is a non-circular hole that fits the transmission shaft 22, rotating the transmission shaft 22 causes the amplitude modulation wheel 311 to be synchronously rotated to roll up the amplitude modulation lift cord 313, as shown in FIGS. 8 and 9. When rotating the amplitude modulation wheel 311 to roll up the amplitude modulation lift cord 313, the conical end portion 315*b* guide the amplitude modulation lift cord 313 to be smoothly wound round the bobbin 315. When the amplitude modulation wheel 311 rolls up the amplitude modulation lift cord 313, the bottom rail 123 is lifted, thereby causing the slats 121 to be received and moved with the bottom rail 123 upwards toward the headrail 11 to the desired elevation.

Figure 5:
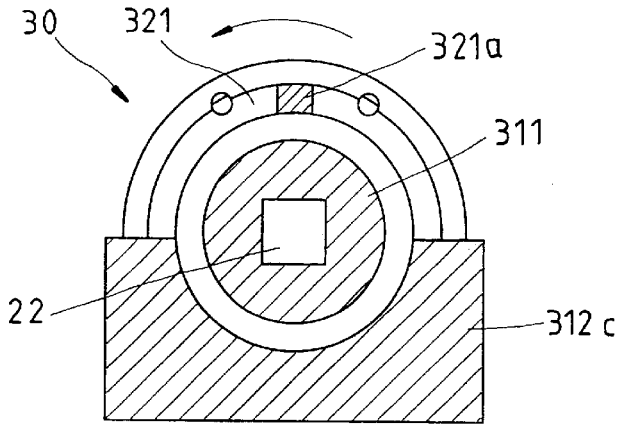
FIGS. 5~7 are side views showing continuous action of the amplitude modulation set and the frequency modulation set according to the present invention.
Figure 6:
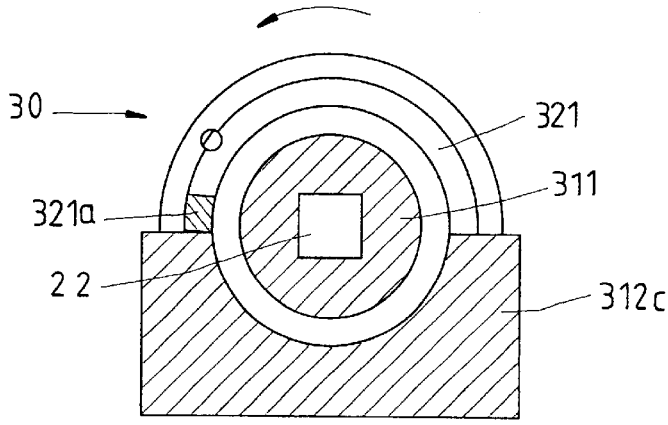

Because the spring 331 forces the frequency modulation wheel 321 against the stop flange 314*a* of the cylindrical wheel body 314 of the amplitude modulation wheel 311, a friction resistance is produced between the frequency modulation wheel 321 and the cylindrical wheel body 314 of the amplitude modulation wheel 311, thereby causing the frequency modulation wheel 321 to be synchronously rotated with the amplitude modulation wheel 311 during rotary motion of the amplitude modulation wheel 311. During rotary motion of the frequency modulation wheel 321, the frequency modulation lift cord 322 is moved, causing the slats 121 to be tilted. When the frequency modulation wheel 321 turns through an angle the protruding block 321*a* touches one shoulder 312*c*. The shoulder 312*c* provides to the protruding block 321*a* a reactive force, which surpasses the friction resistance between the frequency modulation wheel 321 and the cylindrical wheel body 314 of the amplitude modulation wheel 311, as shown in FIGS. 5 and 6, stopping the frequency modulation wheel 321 from rotation with the amplitude modulation wheel 311. Therefore, when the frequency modulation wheel 321 is rotated to this angle, it is disengaged from the amplitude modulation wheel 311. At this time, the transmission shaft 22 continuously rotates the amplitude modulation wheel 311 to roll up the amplitude modulation lift cord 313 and to receive the slats 121 without changing the tilting angle of the slats 121.

Figure 7:
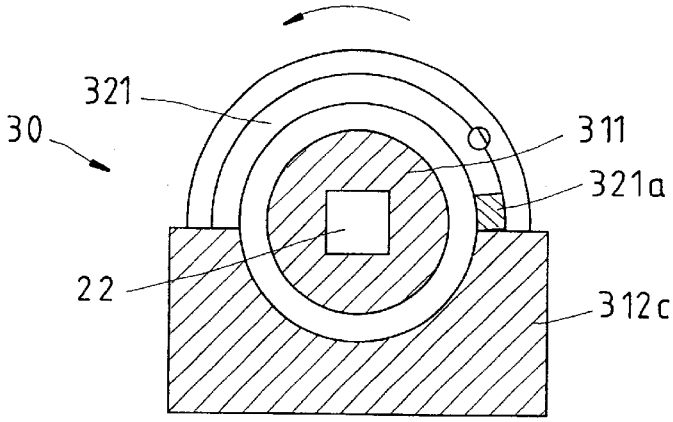

When releasing the slats 121, one operates the signal transmitter 23 to transmit a control signal of releasing the slats to the signal receiver 24. Upon receipt of the signal, the signal receiver 24 immediately drives the motor 21 to rotate in the reversed direction, thereby causing the transmission shaft 22 and the amplitude modulation wheel 311 to be rotated in the same direction. Reverse rotation of the amplitude modulation wheel 311 lets off the amplitude modulation lift cord 313, and therefore the bottom rail 123 and the slats 121 are lowered to extend out the Venetian blind 10. During rotary motion of the amplitude modulation wheel 311 to let off the amplitude modulation lift cord 313, the frequency modulation wheel 321 is forced by the spring 331 against the cylindrical wheel body 314 of the amplitude modulation wheel 311, thereby causing the frequency modulation wheel 321 to be synchronously rotated with the amplitude modulation wheel 311 to tilt the slats 121. However, when the frequency modulation wheel 321 is reversed to such a position that the protruding block 321*a* touches the other shoulder 312*c* of the support 312 (see FIG. 7), the frequency modulation wheel 321 is stopped from rotation with the amplitude modulation wheel 311. At this time, the transmission shaft 22 continuously rotates the amplitude modulation wheel 311 to let off the amplitude modulation lift cord 313 and to release the slats 121 without changing the tilting angle of the slats 121.

With respect to the tilting of the slats 121, the operation is described hereinafter. At first, the user operates the signal transmitter 23 to transmit a slat tilting control signal to the signal receiver 24. Upon receipt of the control signal, the signal receiver 24 immediately drives the motor 21 to rotate the transmission shaft 22 and the amplitude modulation wheel 311, and to further cause the frequency modulation wheel 32 to be rotated synchronously to change the tilting angle of the slats 121. In actual practice, it is not necessary to tilt the slats 121 at a wide angle, therefore the angle of rotation of the frequency modulation wheel 311 can be limited within a limited range. According to the present preferred embodiment, the frequency modulation wheel 321 is rotatable with the amplitude modulation wheel 311 within about 180°. The shoulders 312*c* limit the angle of rotation of the frequency modulation wheel 321. When the slats 121 tilted to the desired angle, the motor 21 is stopped. (during the aforesaid slat angle tilting control operation, the amount of upward or downward movement of the bottom rail 11 due to rotation of the amplitude modulation wheel 311 is insignificant, without affecting the reliability of the operation).

Referring to FIGS. From 10 through 13, the friction transmission mechanism 100 further comprises a detector 60 installed in the middle of the transmission shaft 22. When the slats 121 are moved to the upper limit or lower limit position, the detector 60 is induced to stop the motor 21. According to the present preferred embodiment, the detector 60 comprises a mounting plate 61, a wheel 62, two limit switches 63;64, and a locating block 65. The mounting plate 61 is fixedly fastened to the peripheral wall of the holding chamber 111 of the headrail 11. The locating block 65 is fixedly mounted inside the holding chamber 111 of the headrail 11, having a center screw hole 651. The wheel 62 is coupled to the transmission shaft 22 for synchronous rotation, having an outer thread 621 threaded into the center screw hole 651 of the locating block 65. Rotation of the transmission shaft 22 causes synchronous rotation of the wheel 62 with the transmission shaft 22 and axial movement of the wheel 62 in the locating block 65. The limit switches 63;64 are respectively mounted on the mounting plate 61 at two sides relative to the wheel 62 (in such positions where the wheel 62 touches one limit switch 63 or 64 when the slats 121 moved to the upper limit or lower limit position), and electrically connected to the motor 21. When the slats 121 are moved to the upper or lower limit position, the wheel 62 touches one limit switch 63 or 64, thereby causing the limit switch 63 or 64 to cut off power supply from the motor 21.

The structure and function of the present invention are well understood from the aforesaid detailed description. The advantages of the present invention are outlined hereinafter.

1. Slat Lifting and Tilting Dual-control Function:

The friction resistance between the frequency modulation wheel and the amplitude modulation wheel causes the frequency modulation wheel to be synchronously rotated with the amplitude modulation wheel, and the shoulders of the support and the protruding block of the frequency modulation wheel serve as clutch means to control synchronous rotation of the frequency modulation wheel with the amplitude modulation wheel, and therefore one single driving source is sufficient to control rotation of the amplitude modulation wheel, which controls lifting of the slats, and the frequency modulation wheel, which controls tilting of the slats.

2. Single Drive Source and Compact Size:

Because one single driving source is sufficient to drive the amplitude modulation wheel and the frequency modulation wheel, the invention is inexpensive to manufacture and, requires less installation space.

3. Durable Mechanical Design:

Because the friction transmission mechanism is provided with a detector, the motor is immediately stopped when the slats moved to the upper or lower limit position, preventing damage to the parts of the mechanism.

What the invention claimed is:

1. A friction transmission mechanism mounted in a motor-driven Venetian blind for controlling lifting of slats and bottom rail of the Venetian blind and tilting of slats of the Venetian blind, comprising at least one cord roll-up unit and a driving unit adapted to drive said at least one cord roll-up unit, wherein said cord roll-up unit comprises:

an amplitude modulation set, said amplitude modulation set comprising a support, an amplitude modulation lift cord connected to the slats and bottom rail of the Venetian blind and adapted to lift or lower the slats and bottom rail of the Venetian blind, and an amplitude modulation wheel rotatably engaged to said support and coupled to said driving unit for free rotation relative to said support to roll up or down said amplitude modulation lift cord upon operation of said driving unit, said support comprising a shoulder at one side thereof;

a frequency modulation set, said frequency modulation set comprising a frequency modulation lift cord adapted to tilt the slats of the Venetian blind, and a frequency modulation wheel engaged on said amplitude modulation wheel and adapted to roll up or down said frequency modulation lift cord as the amplitude modulation wheel rotates, said frequency modulation wheel comprising a protruding block adapted to act against said shoulder of said support to limit rotation of said frequency modulation wheel within a predetermined angle after the frequency modulation lift cord has been rolled up or down; and a linkage, said linkage comprising spring means mounted in between said support and said frequency modulation wheel and forcing said frequency modulation wheel against said amplitude modulation wheel to produce a friction resistance that causes said frequency modulation wheel to be rotated with said amplitude modulation wheel upon rotary motion of said amplitude modulation wheel.

2. The friction transmission mechanism as claimed in claim 1, wherein said driving unit comprises a reversible motor, a transmission shaft coupled between said reversible motor and said amplitude modulation wheel and driven by said reversible motor to rotate said amplitude modulation wheel, said transmission shaft having a non-circular cross section fitted into a non-circular axial center through hole of said amplitude modulation wheel, a signal transmitter adapted to transmit control signal, a signal receiver adapted to receive control signal from said signal transmitter and to control operation of said reversible motor subject to received control signal.

3. The friction transmission mechanism as claimed in claim 2, wherein said signal transmitter is a remote controller.

4. The friction transmission mechanism as claimed in claim 2, wherein said signal transmitter is a wired controller.

5. The friction transmission mechanism as claimed in claim 1, wherein said spring means is a coiled spring.

6. The friction transmission mechanism as claimed in claim 5, wherein said amplitude modulation wheel comprises a conical end portion disposed in the periphery thereof at one end and adapted to guide winding of said amplitude modulation lift cord around said amplitude modulation wheel.

7. The friction transmission mechanism as claimed in claim 2, further comprising a detector adapted to cut off a power supply from said reversible motor when the slats of the Venetian blind are lifted or lowered to an upper limit or a lower limit position.

8. The friction transmission mechanism as claimed in claim 7, wherein said detector comprises a mounting plate fixedly mounted in the Venetian blind, a locating block fixedly supported on said mounting plate, a wheel supported in said locating block and coupled to said driving unit for rotation and axial movement upon operation of said driving unit, and two limit switches disposed at two sides in an axial displacement path of the wheel of said detector and electrically connected to said driving unit and adapted to cut off power supply from said driving unit when touched by the wheel of said detector.

9. The friction transmission mechanism as claimed in claim 8, wherein said limit switches are respectively disposed in positions corresponding to the upper and lower limit positions of the lifting or lowering of the slats of the Venetian blind.

* * * * *